US007055249B1

(12) United States Patent
Chao-Huan

(10) Patent No.: US 7,055,249 B1
(45) Date of Patent: Jun. 6, 2006

(54) STRUCTURE OF A KNIFE

(76) Inventor: Teng Chao-Huan, P.O. Box 697, Fongyuan City, Taichung County (TW) 420

( * ) Notice: Subject to any disclaimer, the term of this patent is extended or adjusted under 35 U.S.C. 154(b) by 204 days.

(21) Appl. No.: 10/844,366

(22) Filed: May 13, 2004

(51) Int. Cl.
*B26B 5/00* (2006.01)

(52) U.S. Cl. ..... 30/337; 30/330

(58) Field of Classification Search ..... 30/339, 30/329, 330, 335, 337, 314, 2, 125
See application file for complete search history.

(56) References Cited

U.S. PATENT DOCUMENTS 4,922,610 A * 5/1990 Szabo ..... 30/330
5,301,428 A * 4/1994 Wilcox ..... 30/335
6,263,577 B1 * 7/2001 Wonderley ..... 30/335
6,308,422 B1 * 10/2001 MacDonald ..... 30/125
6,484,404 B1 * 11/2002 Kao ..... 30/2

* cited by examiner

*Primary Examiner*—Stephen Choi

(57) ABSTRACT

A structure of a knife includes an arcuate main body combined with two corresponding housings, an extension and a subordinate housing, a blade rack capable of holding different kind of blades releasably secured in the front end, a blade chamber in a middle portion with a slender magnet disposed thereunder to prevent the stored blades from sticky together, a roller and a press plate disposed at rear end for respectively making a track on the carpet being cut and to get ride the crepes in the carpet.

5 Claims, 10 Drawing Sheets

STRUCTURE OF A KNIFE

BACKGROUND OF THE INVENTION

The present invention relates to cutting tools and more particularly to a structure of a knife which is adapted to cut the carpet and capable of storing and assembling different kind of blades.

Generally, a heavy duty artistic knife or other cutting means adapted to cut the carpet requires different blade. However, there are cutting tools can only suit to one or two kinds of blades. But the cutting of carpet requires many kind of blades to cope with different cutting conditions. Thus the operator has to prepare a lot of knives of different blades that causes great inconvenience to the operator.

Besides, many of these knives have blade chamber to store the spare blades which have always been applied with the lubricating oil for rust-proof. But one is difficult to pick up the spare blade on one by one basis due to the sticky of the oil and the thin of the blade. Therefore, some of the producers embeds a magnet in the wall of the chamber. Because of the magnetic attraction, that causes more difficult to pick up a single blade from the chamber.

Further, the operator needs a pressing means to press the carpet when it becomes crepe or beside a wall so that is a wearisome job for an operator to repeatedly change the tools.

SUMMARY OF THE PRESENT INVENTION

The present invention has a main object to provide a structure of a knife which is capable of coupling with different blade available in the market such that the operator uses only one kind of the knife to perform different cutting requirement of the carpet.

Another object of the present invention is to provide a structure of a knife in which a blade chamber is provided to store different kind of blades, each of the storing blade has a small gap therebetween to facilitate the operator to pick up a blade on one by one basis.

Further object of the present invention is to provide a structure of a knife which has a press plate at rear end which presses the turning point or the crepe of the carpet or twists the carpet for 90 degrees without using other tools.

Accordingly, the structure of a knife of the present invention comprises general a main body or handle which is combined with two corresponding arcuate housings. The front inner side of the first housing has a pair of positioning rods, a stop wall and a circular magnet. A blade chamber in a middle portion stores different kind of the spare blades. A slender magnet disposes under the chamber which provide the magnetic rays parallel to the blades for preventing the stored blades from sticky together. A slant extension on the rear end has a roller and a concave for disposing a spring biased catch which has a projection at front end. An inverse trapezoid blade rack is fixed to the front end for disposing a blade of front or back side. A second housing rotatably combines with the first housing by screw having a check depression in rear end releasably checked by the catch. A subordinate housing connects the slant extension with a soft pad and a roller disposed therebetween. The subordinate housing further has a press plate projected outward from a rear end thereof for preventing the carpet from a crepe.

The present invention will become more fully understood by reference to the following detailed description thereof when read in conjunction with the attached drawings.

DETAILED DESCRIPTION OF THE PREFERRED EMBODIMENT

Figure 1:
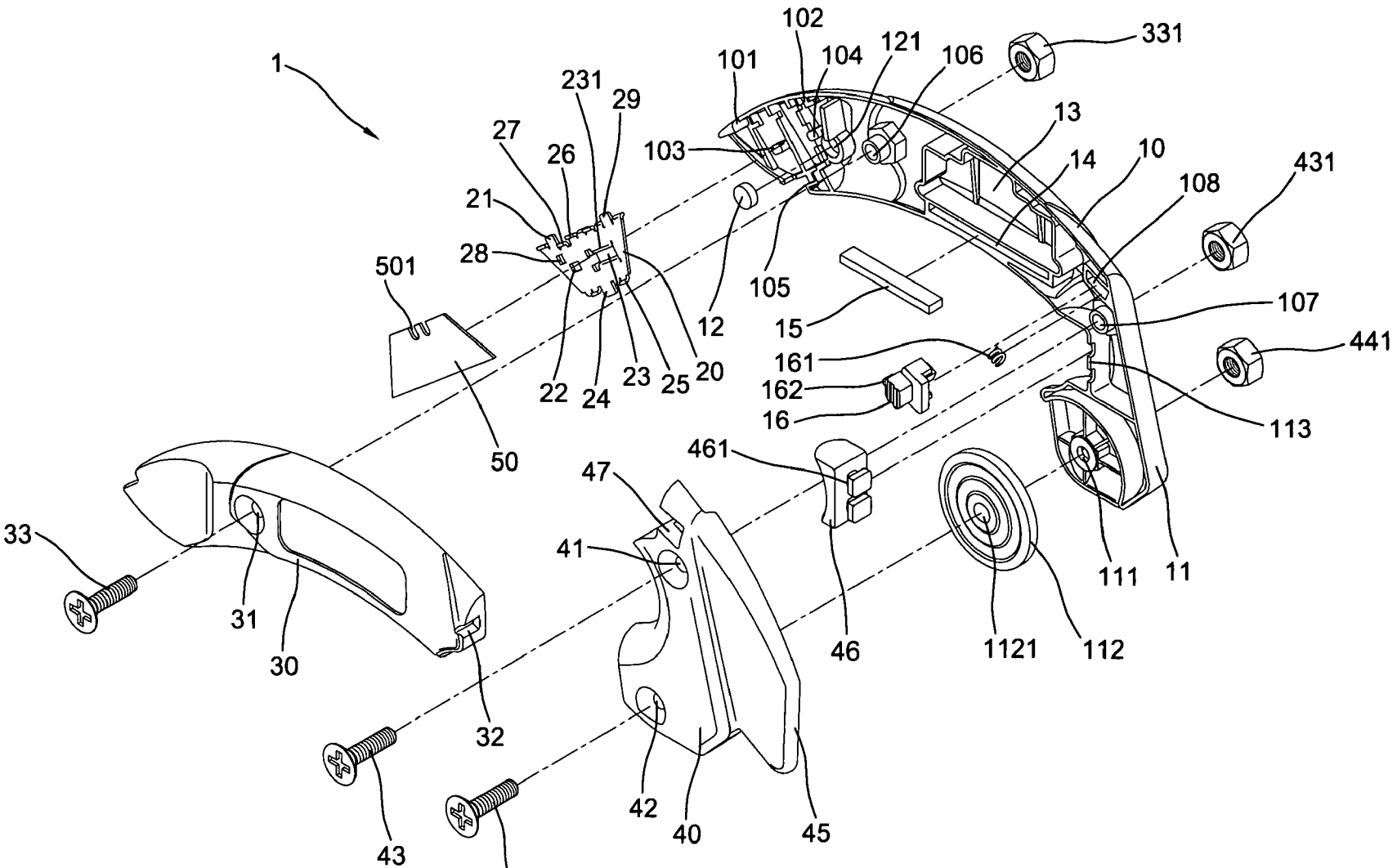
FIG. 1 is an exploded perspective view of the preferred embodiment of the knife according to present invention.
Figure 2:
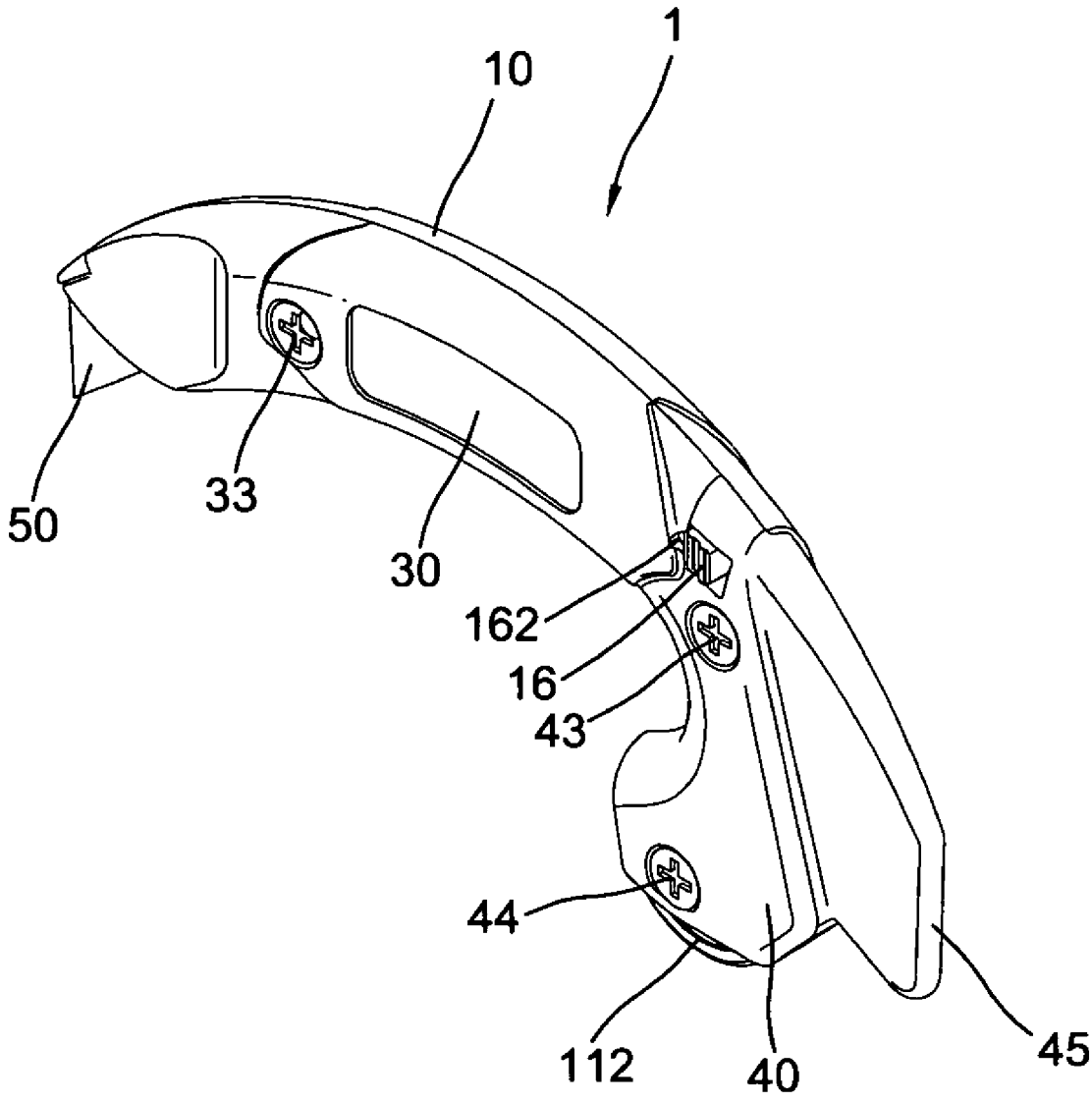
FIG. 2 is a perspective view of the assembly of FIG. 1.
Figure 3:
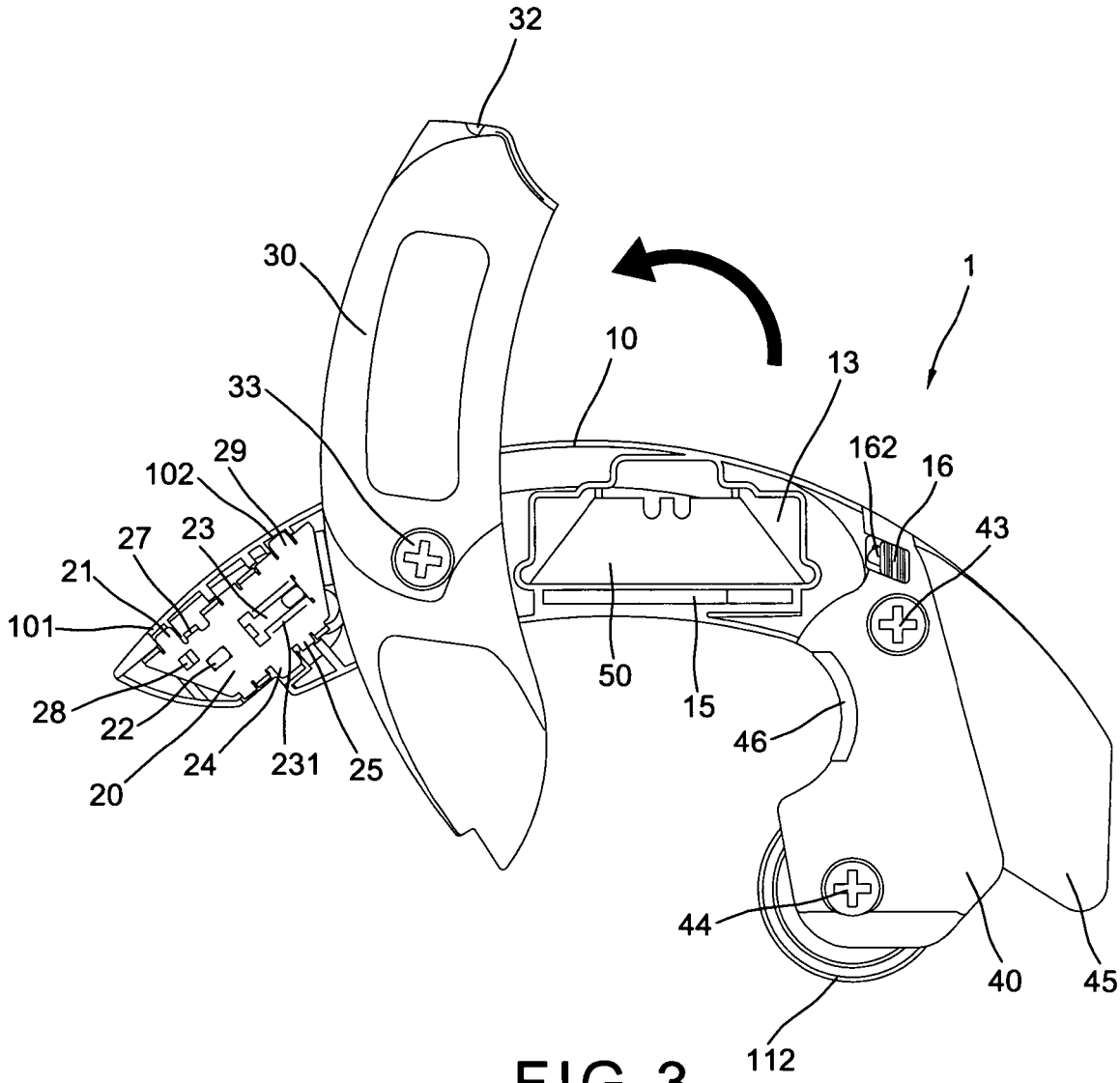
FIG. 3 is a plane view indicating that the second housing is rotated for about 90 degrees.

With reference to FIGS. 1, 2 and 3 of the drawings, the structure of a knife of the present invention comprises a main body or handle 1 which is combined with a first and a second corresponding housing 10 and 30, an inverse trapezoid blade rack 20, a subordinate housing 40 and a blade 50.

Figure 6:
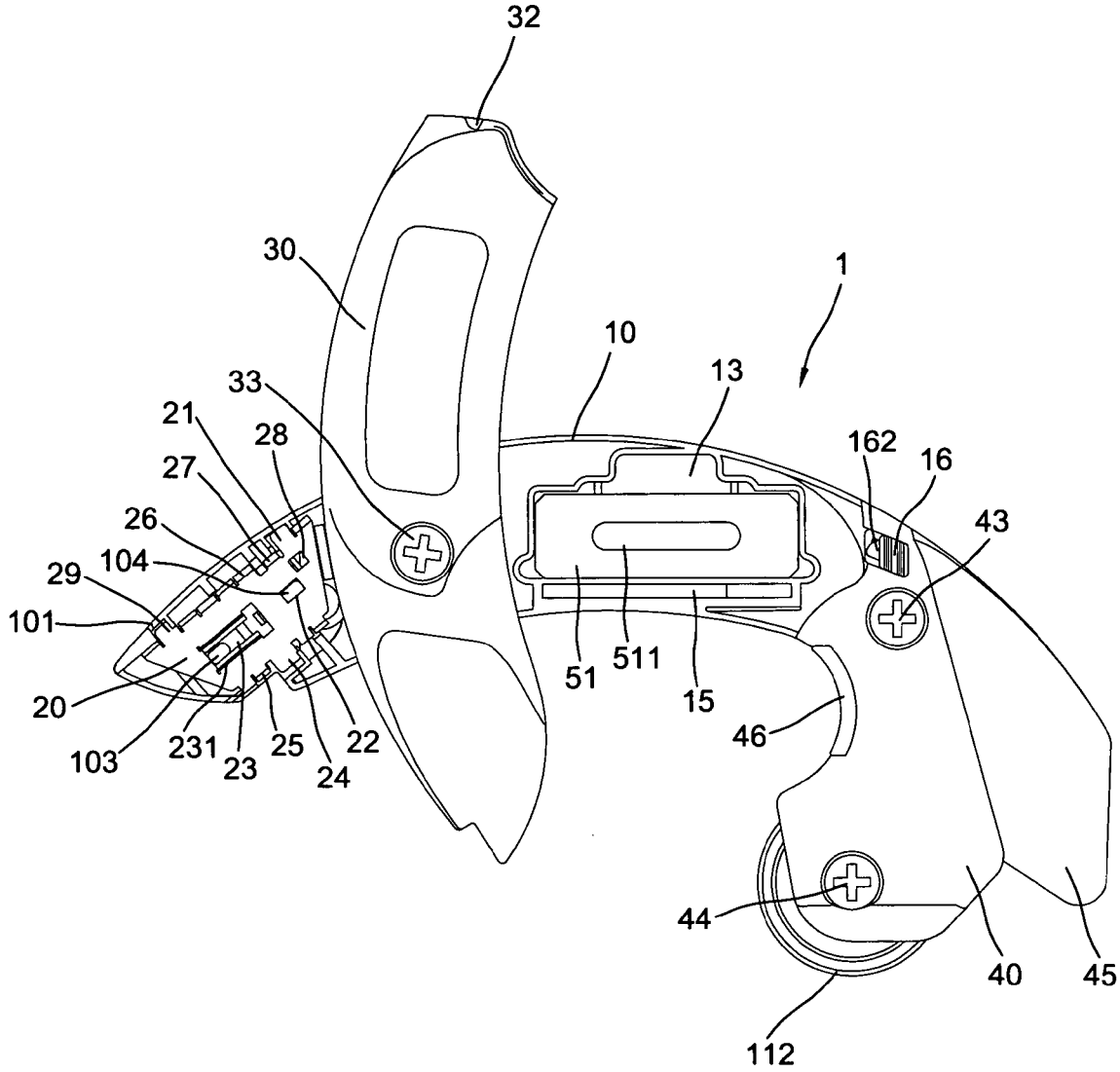
FIG. 6 is a plane view indicating that the back side of the blade rack is toward outside during the second housing being rotated for about 90 degrees.

In the first corresponding housing 10, there is an extension 11 projected downward from the rear end, a circular magnet 12 disposed in a circular protrudent cavity 121 which is provided to attract the blade rack 20, a first positioning groove 101 in the top of the front end, a second positioning groove 102 in a top apart from the first positioning groove 101, a first positioning rod 103 on a middle portion between the positioning grooves 101 and 102, a second positioning rod 104 on a middle portion beneath the second positioning groove 102, a stop partition 105 beneath the second positioning rod 104, a first protrudent through hole 106 on a middle portion aside the circular cavity 121, a blade chamber 13 in a rear portion for storing different kind of spare blades 50 and 51 therein (as shown in FIGS. 3 and 6), a slender cavity 14 beneath the blade chamber 13 for disposing a slender magnet 15 therein, a second protrudent through hole 107 and a rectangular concave spacedly formed in the rear end thereof. The extension 11 has a reinforced axial hole 111 on an inner side adjacent the lower end made engageable with the central bore 1121 of a roller 112, and a serrated side wall 113.

Figure 4:
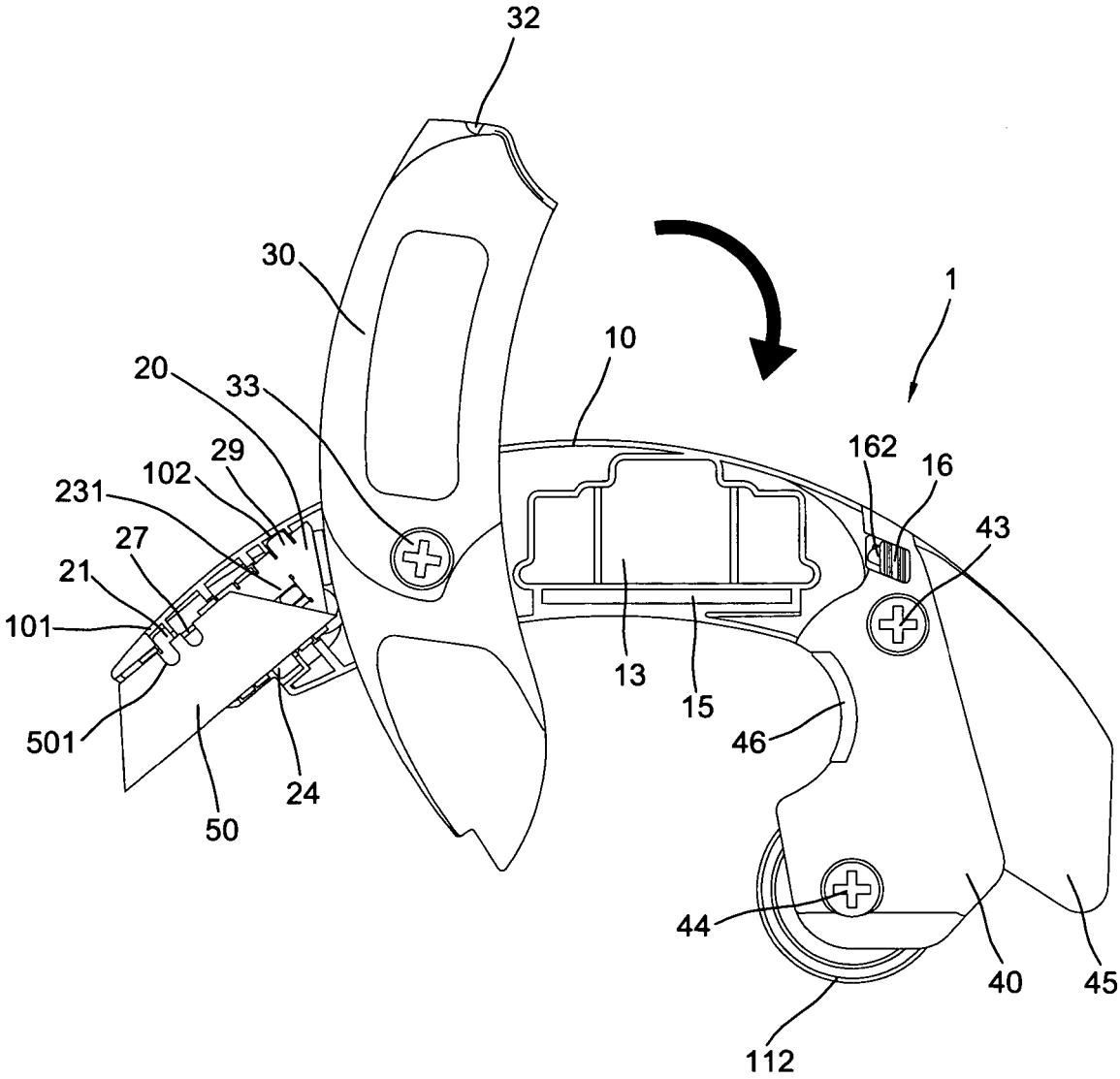
FIG. 4 is a plane view indicating that the second housing is rotated to facilitate the blade to assemble to the blade rack.
Figure 5:
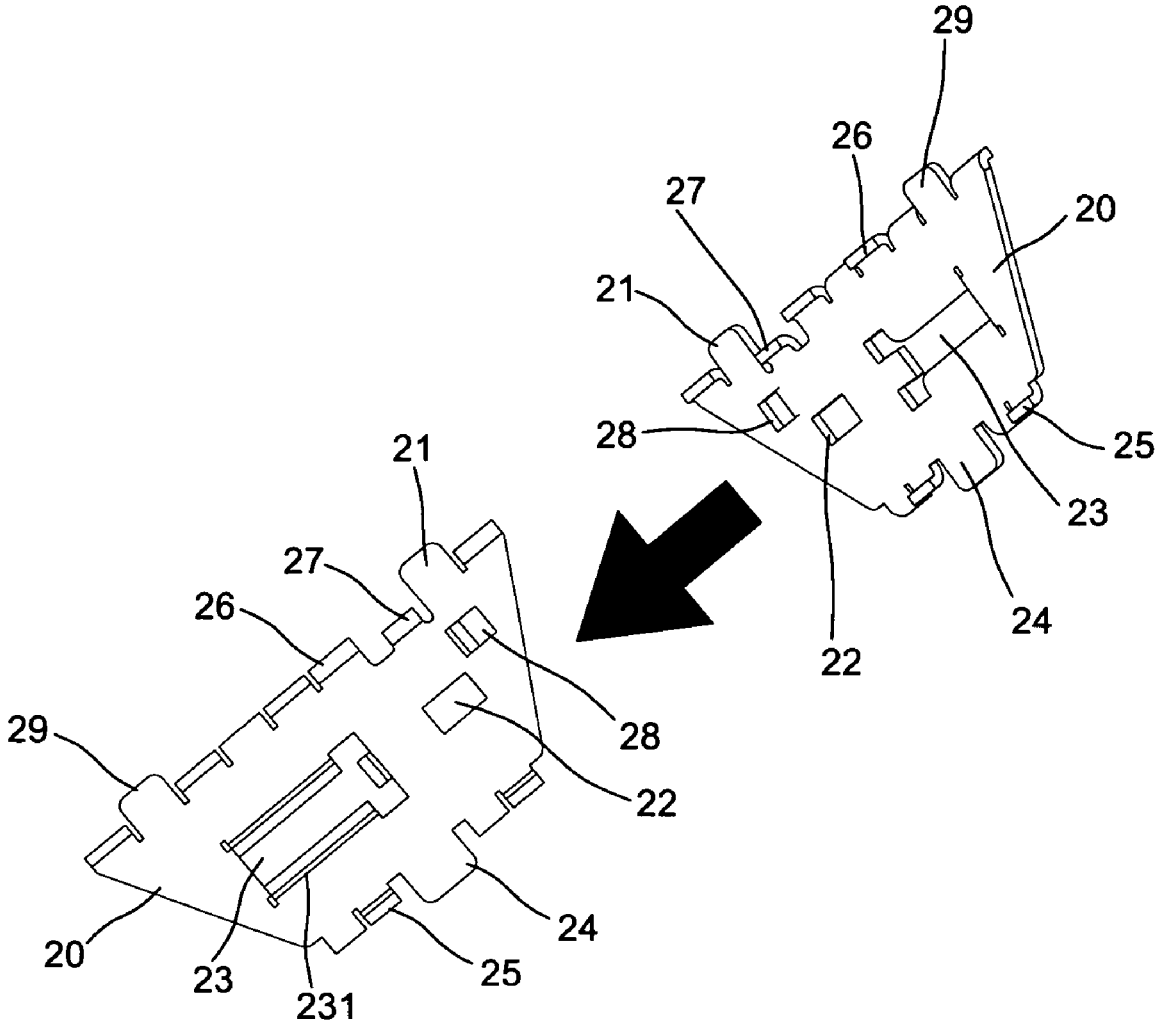
FIG. 5 is a perspective to show the front and the back sides of the blade rack.
Figure 7:
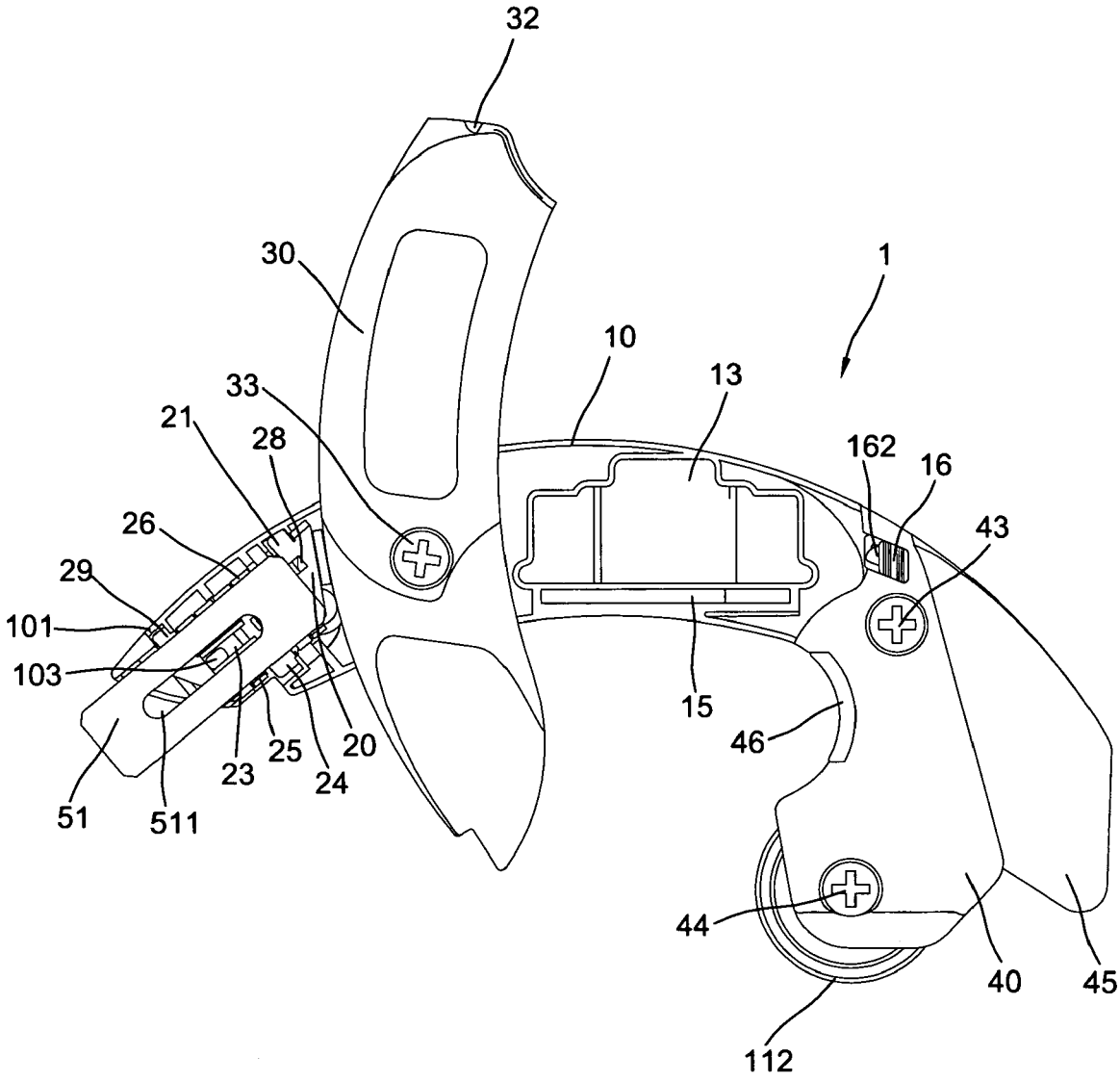
FIG. 7 is a plane view indicating that a double-edge blade assembled to the blade rack.

The inverse trapezoid blade rack 20 (as shown in FIG. 5) disposes in the front end of the first corresponding housing 10 and has a pair of upper projections 21 and 29 formed spaced apart on the top respectively engaged with the positioning grooves 101 and 102, a plurality of foreward bent and backward bent pieces 26 and a press plate 27, a side the upper projections 21 and 29, a square through hole 22 and a rectangular through hole 23 formed spaced apart in the middle portion thereof respectively engaged with the positioning rods 103 and 104, a lower projection 24 projected downward from a lower central edge and engaged with the stop partition 105, a plurality of backward bent pieces 25 aside the lower projection 24 and an additional square through hole 28 formed in a surface beneath the upper projection 29. Wherein the rectangular through hole 23 has a pair of bent over flanges 231 and both the square through holes 22 and 28 have a bent over flange which is provided to hole the blade 50 thereon. Besides, both of the right side and the back side of blade rack 20 may face upward to serve for different shape of blades (as shown in FIGS. 4 and 7). A detent 16 has a striped outer surface and a catch 162 at front end engaged into the rectangular concave and biased by a spring 161 on the rear end thereof. A soft pad 46 having the coupling grooves 461 in the root of the two square protrusions partially engaged with serrated side wall 113 of the extension 11.

The second corresponding housing 30 combines with the first corresponding housing 10 and has a first depressed through hole 31 engaged with the protrudent through hole 106 and rotatably secured by a bolt 33 and a nut 331 and a check recess 32 in the rear end engaged with the catch 162 of the detent 16 such that the second corresponding housing 30 can be rotated on the bolt 33 and became stable by the detent 16.

The subordinate housing 40 has a second depressed through hole in an upper portion engaged with the second protrudent though hole 107 and secured by a bolt 43 and a nut 431, a third depressed through hole 42 engaged sequentially with the central bore 1121 of the roller 112 and the reinforced axial hole 111 and secured by a bolt 44 and nut 441, a receiving space 47 in front end for receiving the striped outer surface of the detent 16 and a press plate 45 extended rearward from the rear wall for pressing the crepes of a carpet. After the subordinate housing 40 engaged with the extension 11, the roller 112 is able to rotate and the soft pad 46 is secured by an inner wall of the subordinate housing 40 and partially exposes out of the housing 40.

When mounts a trapezoid blade 50 on the blade rack 20, engage the pair of U-shaped slots 511 in the top of the blade 50 with the press plate 27 of the blade rack 20 and respectively stop the upper edge and the lower edge of the blade 50 against the foreward bent pieces 25 and 26 (as shown in FIG. 4) so that the blade is firmly fixed. FIGS. 6 and 7 indicate that the blade rack 20 is turned over to have its backside toward outward. However, the upper projections 21 and 29 are still engaged with the positioning grooves 101 and 102, the rectangular through hole 23 and the square through hole 22 are also engaged with the positioning rods 103 and 104, and the lower projection 24 stops against the stop partition 105, too. The turned over blade rack 20 suits to mount a double-edge blade 51 which has a rectangular central hole 511 engaged with the bent over flanges 231 of the rectangular through hole 23. Further, the structure of this blade rack 20 also suit to mount a single U-shaped slot blade or a blade having an arcuate hooked edge.

Figure 8:
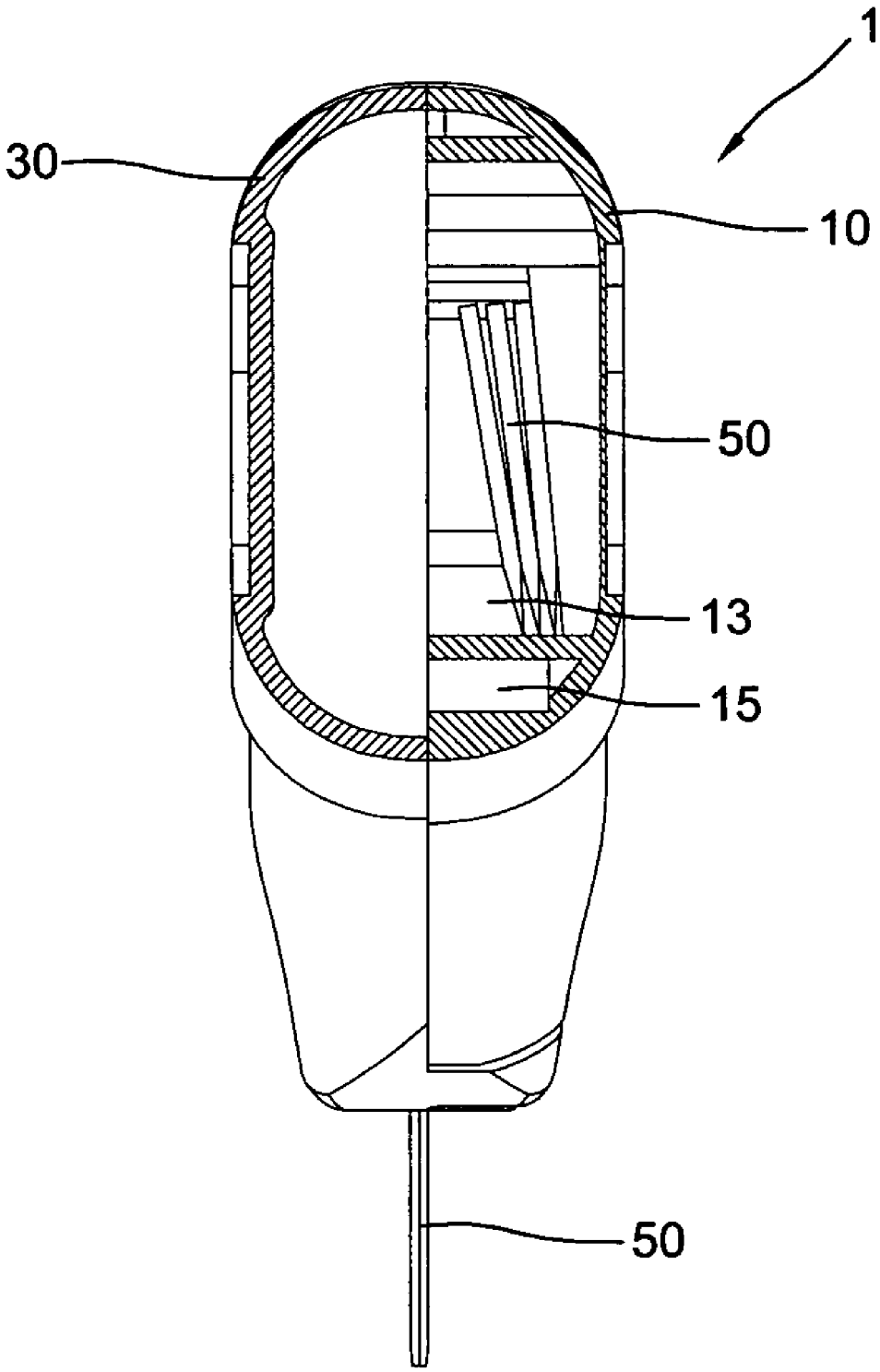
FIG. 8 is a top view and partially sectional view indicating that the blades inside the blade chamber are separated from each other.

Referring to FIGS. 1 and 8, the blade chamber 13 is provided to store different shapes of blades. Due to the magnetic line of force of the slender magnet 15 that is parallel to these blades and perpendicular to the chamber 13. So that a small gap is therefore presented between each adjacent blades which are readily picked up without sticky together.

Figure 9:
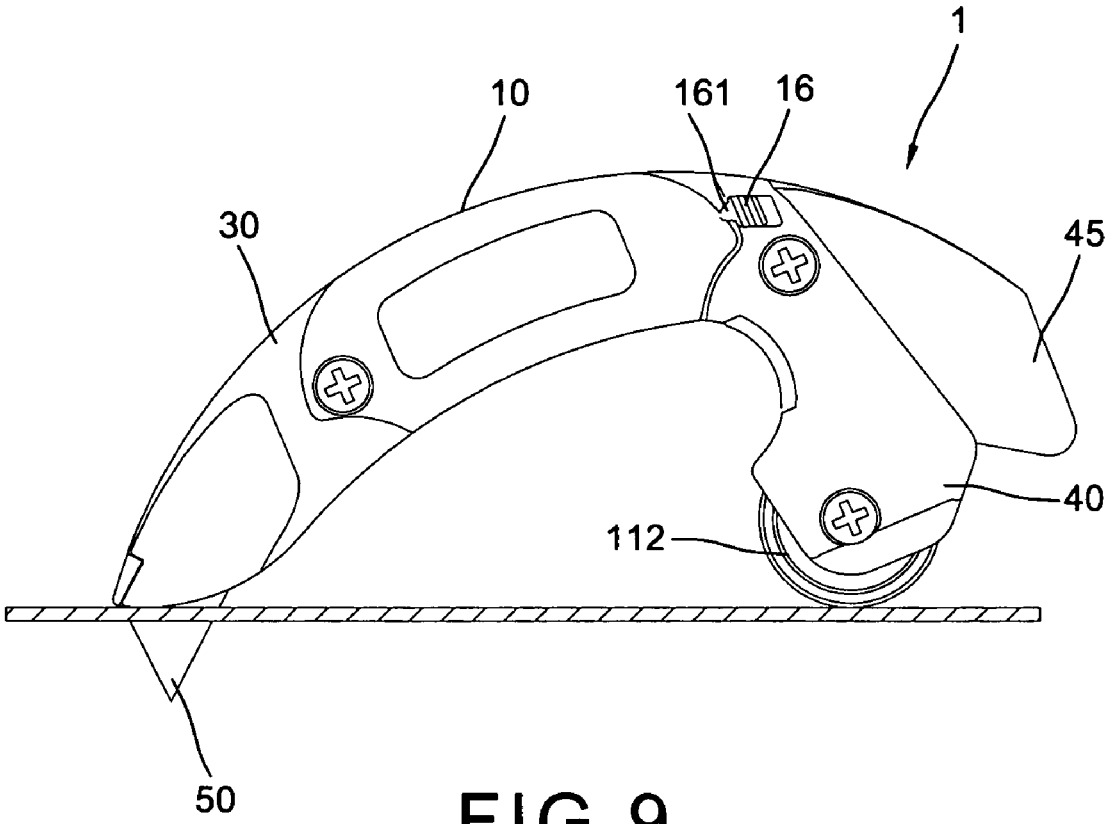
FIG. 9 is a plane view indicating that the knife of the present invention is cutting a carpet.
Figure 10:
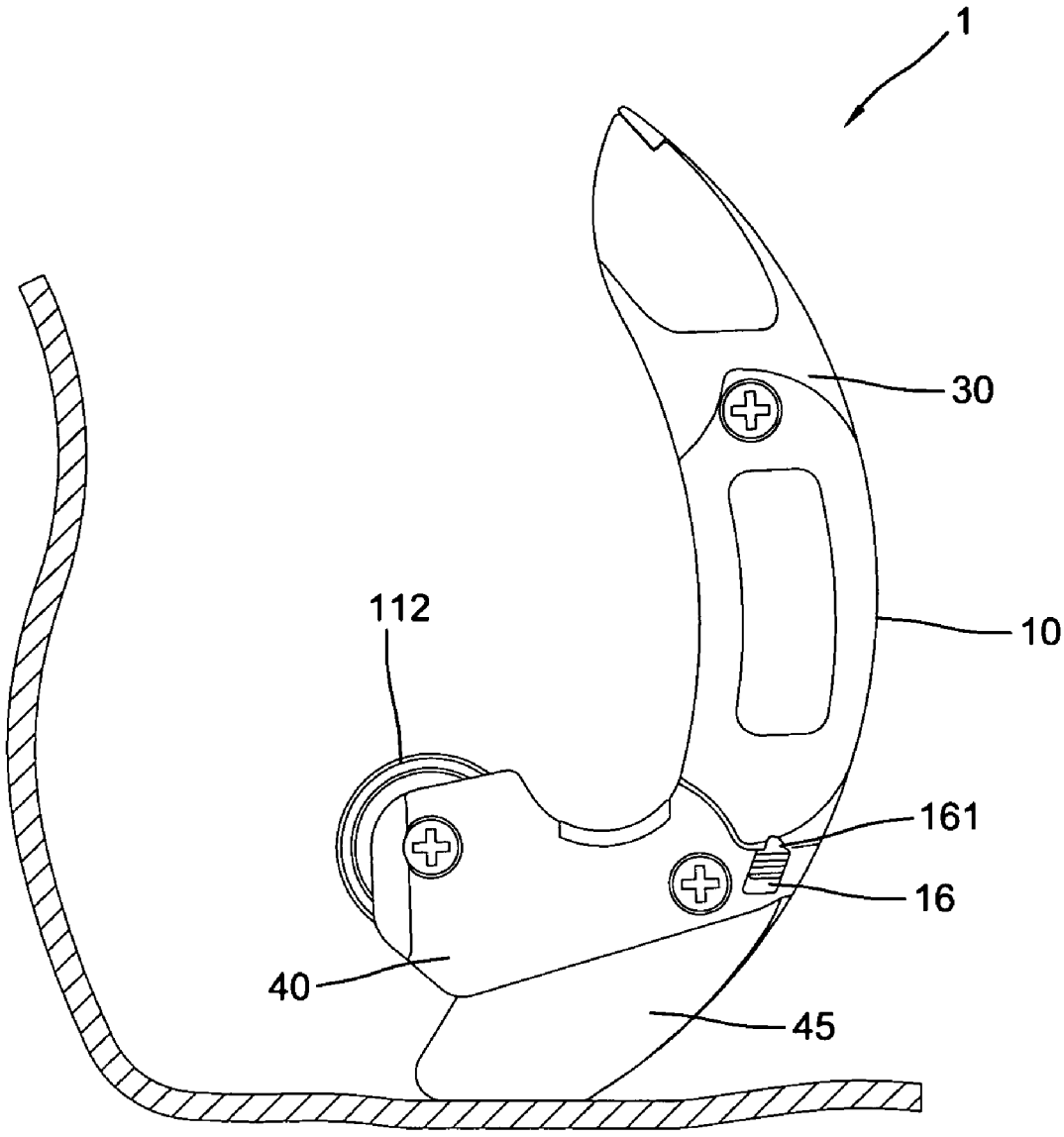
FIG. 10 is a plane view indicating that the press plate is pressing the crepes of the carpet at a corner.

FIGS. 9 and 10, in application, the operator has to skillfully grasps the handle 1 and lets the roller to rotate on a carpet in order to make a track on the surface of the carpet. Then the blade cuts the carpet by following the track. So that the result should be very neat. If a crepe is found on the carpet or that the carpet at a corner between a wall and the floor, the operator can use the press plate 45 to get rid of those problems.

When the edge of the blade 50 or 51 is found blunt, pull the detent 16 rearward to have its projection 162 disengaged with the check recess 32 in the rear end of the second corresponding housing 30 which is now set free to rotate for about 90 degrees (as shown in FIG. 3). So that both the blade rack 20 and the blade chamber 13 are exposed out to enable the operator removing the old blade 50 or 51 and picking a new blade 50 or 51 up from the blade chamber 13 and mounting onto the blade rack 20. Then rotate the second corresponding housing 30 back to its original position and be locked again by the detent 16 in a snap fitting.

The feature of the knife of the present invention is set forth as follows:

a) the addition of a blade rack 20 enables the handle 1 to suit any kind of blade available in the market and need not to prepare different shape of knives, b) a small gap exist between each adjacent blade 50 or 51 in the blade chamber 13 that enables the operator to readily pick up a blade 50 or 51 from the blade chamber 13, c) the addition of a press plate 45 facilitates the operator to get rid of the crepes in the carpet, and d) the second corresponding housing 30 is readily to open and automatically to check by a detent.

Note that the specification relating to the above embodiment should be construed as an exemplary rather than as a limitative of the present invention, with many variations and modifications being readily attainable by a person of average skill in the art without departing from the spirit or scope thereof as defined by the appended claims and their legal equivalents.

I claim:

1. A structure of a knife comprising:

a main body combined with a first and second corresponding housings;

said first housing having an extension extended downward from rear end, a circular protrudent cavity on an inner surface adjacent front end for disposing a circular magnet therein, a first and second positioning grooves spacedly formed in a top abutting the front end, a first and second positioning rods spacedly formed beneath said positioning grooves, a stop partition formed under said positioning rod, a first protudent through hole formed in a middle inner surface aside said protrudent cavity, a blade chamber for storing different kinds of blades formed in a middle inner surface, a slender cavity under said blade chamber for disposing a slender magnet therein, a rectangular concave and a second protrudent through hole formed spaced apart in the rear end thereof abutting the extension which has a reinforced axial hole centrally formed above lower end and a serrated inner wall under the rear end of the first corresponding housing;

an inverse trapezoid blade rack disposed in the front end of the first corresponding housing and attracted by the circular magnet, having a pair of upper projections formed spaced apart and respectively engaged within said positioning grooves, a plurality of forward and backward bent pieces together with a press plate aside said upper projections, a first square through and a rectangular through hole formed spaced apart in central portion thereof respectively engaged with said positioning rods, a second square through hole above said first square through hole, a lower projection projected downward from lower central edge engaged with said stop partition and a plurality of backward bent pieces aside said lower projection wherein said rectangular through hole has a pair of bent over flanges and said first and second square through holes each has a single bent over edge;

a detent disposed into said rectangular concave and biased on rear end by a spring having a striped outer surface and a catch at fore end;

a soft pad having a coupling groove in root of a pair of square protrusions partially engaged with the serrated side wall of said extension;

a trapezoid blade mounted on said blade rack having a pair of U-shaped slot in top edge engaged with the press plate of said blade rack and an upper and a lower edges respectively held by the forward bent pieces of said blade rack;

said second corresponding housing having a first depressed through hole engaged with the first protrudent through hole of said first corresponding housing and rotatably secured by a bolt and nut and a check recess in rear end releasably engaged with the catch of said detent;

a subordinate housing engaged with said extension having a second depressed through hole in an upper portion engaged with the second protrudent through hole and secured by a bolt and nut, a third depressed through hole in a lower portion engaged with the axial hole of said extension and secured by a bolt and nut with a roller engaged therebetween, wherein said roller has a central bolt rotatably on said bolt, a receiving space in fore end for receiving the striped outer surface of said detent, an inner edge engaged within the coupling groove of said soft pad which is partially exposed out of the subordinate housing and a press plate projected outward from a rear side of said subordinate housing.

2. The structure as recited in claim 1, wherein said blade rack has a right side and a backside useful to hold different kind of blades.

3. The structure as recited in claim 2, wherein said blade rack has a plurality of bent over flanges which are useful to hold the edges of the blade.

4. The structure as recited in claim 1, wherein said roller is used to make tracks on a carpet to facilitate a neat cutting.

5. The structure as recited in claim 1, wherein said press plate is adapted to get rid the crepes in the carpet.

* * * * *